United States Patent [19]

Hasty

[11] Patent Number: 4,563,847

[45] Date of Patent: Jan. 14, 1986

[54] UNIVERSAL FLASHING FOR ROOF VENT PIPES

[75] Inventor: William E. Hasty, Dallas, Tex.

[73] Assignee: W F Products Corporation, Garland, Tex.

[21] Appl. No.: 389,332

[22] Filed: Jun. 17, 1982

[51] Int. Cl.[4] ..... E04D 1/36; E04D 13/14

[52] U.S. Cl. ..... 52/219; 52/58; 52/98; 52/199; 285/4; 285/44

[58] Field of Search ..... 52/58, 219, 98, 199; 285/42, 43, 3, 4, 44

[56] References Cited

U.S. PATENT DOCUMENTS

| | | | |
|---|---|---|---|
| 1,258,884 | 3/1918 | Fife | 285/43 |
| 1,317,446 | 9/1919 | Hollaender . | |
| 3,313,559 | 4/1967 | Kifer . | |
| 3,602,530 | 8/1971 | Elwart . | |
| 3,677,576 | 7/1972 | Gustafson . | |
| 3,731,952 | 5/1973 | Elwart . | |
| 3,807,110 | 4/1974 | Kaminski | 52/219 |
| 3,945,163 | 3/1976 | Nagler et al. . | |
| 4,010,578 | 3/1977 | Logsdon . | |
| 4,120,129 | 10/1978 | Nagler et al. . | |
| 4,265,058 | 5/1981 | Logsdon | 52/58 |
| 4,333,660 | 6/1982 | Cupit | 52/60 |

FOREIGN PATENT DOCUMENTS

| | | | |
|---|---|---|---|
| 640736 | 5/1962 | Canada | 285/3 |

*Primary Examiner*—Donald G. Kelly

*Assistant Examiner*—Michael Safavi

*Attorney, Agent, or Firm*—David H. Semmes; Warren E. Olsen

[57] ABSTRACT

An improvement to a universal flashing for roof top and vent pipe geometries characterized by differing pipe diameters and roof slop angles. The present improvement relates to a ring collar assembly which comprises a plurality of stepped sealing portions, each portion adapted to engage a different vent pipe diameter and frangibly be separated from the wall of said body member, wherein for a given pipe diameter a sealing portion further comprises a set of first and second projections disposed generally perpendicular to the flashing body centerline, each extending from a proximate end to a distal end which defines a circular flange surface spaced first and second dimensions about the centerline. The first dimension is less than the second dimension and both first and second dimensions are less than the outer diameter of the given pipe diameter for which sealing engagement is desired, and the projections are of a uniform thickness less than the wall thicknesses of the body member. At least one of said projections is removable from said body member through a frangible wall section defined within the wall of the body member and adjacent to the surface of another projection, whereby modification of the ring collar assembly for successively larger vent pipe diameters is accomplished simply by separating one or more projections at a frangible wall section.

5 Claims, 7 Drawing Figures

UNIVERSAL FLASHING FOR ROOF VENT PIPES

BACKGROUND OF THE INVENTION

1. Field of the Invention

An improved universal flashing for roof top and vent pipe geometries characterized by differing pipe diameters and roof slope angles, which more effectively prevents water leakage, either past the seal between the flashing and the vent pipe, or between the roof and the base flange of the flashing.

2. Description of the Prior Art

Various prior flashings have been taught, wherein a flexible configuration is used to adapt to various vent pipe configurations, and varying roof pitch slope angles. The following patents are illustrative of the state of the prior art:

FIFE, U.S. Pat. No. 1,258,884
HOLLAENDER, U.S. Pat. No. 1,317,446
KIFER, U.S. Pat. No. 3,313,559
ELWART, U.S. Pat. No. 3,602,530
GUSTAFSON, U.S. Pat. No. 3,677,576
ELWART, U.S. Pat. No. 3,731,952
NAGLER ET AL., U.S. Pat. No. 3,945,163
LOGSDON, U.S. Pat. No. 4,010,578
NAGLER ET AL., U.S. Pat. No. 4,120,129

The present invention is distinguished over the collective teachings of the prior art in defining a flexible flashing peculiarly well adapted to seal against varying vent pipe diameters, while providing easy removal for sets of sealing projections from the sealing area, to accomodate installation upon a larger vent pipe diameter. While certain prior flashing teachings are analogous in that an elastomeric material is distended around a vent pipe for sealing thereof, the rooftop environment is quite hostile, and sealing difficulties often arise either from improper installation, or simple deterioration. The present invention allows differing vent pipe diameters (and varying roof pitch angles) to be sealed very firmly and effectively, since sets of frangible sealing projections successively are removed, for larger vent pipe diameter. The following brief discussion of prior art attempts at universal flashings, will illustrate the advantages of the present invention.

FIFE illustrates it long has been known to define a flashing to accomodate various pipe diameters and roof pitch angles. FIFE taught a frustoconical sheet metal base attached to a caulking sleeve of soft metal, such as lead. The lead is pounded into a tight contact with a pipe and is malleable enough to adjust to various pipe angles. A groove as a cutting guide is provided should a larger diameter pipe be fitted. Such soft metal flashings are still used today, but are prohibitively expensive and subject to improper fit, though they resist attack by high temperature roofing materials.

HOLLAENDER illustrates a pipe with lead flashing and corrugations to allow bending of the frustoconical member to fit various angles, with the pipe sealed by a ring clamp, to urge the pliable material around the vent diameter.

KIFER illustrates a dome-shaped sheet metal conduit with an elastomeric collar, wherein the collar has a slightly smaller diameter than the outer diameter of one pipe meant to pass therethrough, whereby the collar will distend and supply a tight seal. Flexibility of the collar is configured to allow the pipe roof angle to be slightly varied.

ELWART '530 illustrates one approach to an universal flashing, wherein cutting lines are defined at the bottom of a flexible, corrugations in an annular array, and further corrugations are provided in the frustoconical body of the flashing, to allow conforming to slightly different roof pitches.

GUSTAFSON illustrates an elastomeric collar wherein the wall contour and shape of the collar is configured so that a given pipe diameter will be engaged over a substantial distance, with different bell shaped wall structures required for 3" or 4" pipes, for example.

ELWART '952 is denominated an improvement over his earlier patent, wherein a rigid polyethelene, frustoconical member supports a separate neoprene O-ring seal, wherein further the rigid polyethelene member may be cut to expose another O-ring, for a larger pipe diameter.

NAGLER ET AL. '163 illustrates a moulded box type of roof flashing, wherein separate raised circular portions are provided to pass a pipe.

LOGSDON illustrates a two piece roof flashing structure wherein a separate resilient elastomeric sealing member is pivotable within a rigid retainer ring, so that a single pipe diameter can be oriented at various roof pitch angles.

NAGLER ET AL. '129 illustrates a seamless aluminum housing that supports a cap of elastomeric material, which must be selectively severed and a clamp then placed around the desired vent pipe diameter.

The present invention is distinguished from these prior art approaches by a dual-seal concept that is of simple construction, and whereby a different set of projections is available to accomodat each of up to four pipe diameters. The present invention also is distinguished from the prior art in a preferred embodiment by being entirely of a one-piece elastomeric material, such as flexible PVC, which enables not only various roof pitch angles easily to be accomodated, but also enables the flange surface effectively to seal against both a vent pipe diameter, and also a roof surface.

SUMMARY OF THE INVENTION

The improvements to a flashing for rooftop and vent pipe geometries varying over a fairly substantial range taught herein is characterized, in a preferred embodiment, by a one-piece flexible PVC plastic construction, which combines both excellent sealing properties, and resistance to aging. The preferred embodiment accomodates one and one-half, two inch and three inch I.D. vent pipe diameters of either cast iron, plastic or copper. The flashing is universal in the sense that the quality of the seal is maintained despite selective removal of one or more sets of projections to accomodate a given pipe diameter, and the flexible base flange can be installed upon any type of roof, whether it be flat, built-up, or pitched with tile, ceramic or rough shakes, without concern as to the integrity of the flange seal against any surface.

The planar base flange preferrably is of the same flexible PVC material as the body member, but may be of a separate high temperature material, such as aluminum, to resist a hot tar built-up roof application. The base flange connects and supports the bottom end of a frustoconical body member, in a conventional fashion, and the body member has a top end comprising a sealing ring collar assembly which is distended similarly against different pipe diameters, since a selective removal of sets of projection seals is allowed.

The ring collar assembly comprises a plurality of stepped, annular sealing projections. At least two projections are configured to define a set of circular dimensions that are adapted to engage at two locations on a given vent pipe outer diameter. The given pipe diameter is sealingly engaged by at least two projections, which are configured not to be affected by roof pitch angles different than a nominal angle.

A set of first and second projections are disposed generally perpendicular to a centerline of the frustoconical portion, which also renders the projections substantially perpendicular to the centerline of a vent pipe oriented at a standard roof pitch, e.g., a five inches rise in a twelve inch run. For other roof pitch angles, the seals tend to be urged out of a circular contact, and into an elliptical contact. For a given set of projections, a first projection is annular with a proximate end connected at a first location of the frustoconical body member and extends inwardly to a distal end which defines a first circular dimension. The second projection is annular and extends from a proximate end attached at a second location of the body wall member to a distal end which defines a second circular dimension, concentric to the first dimension. The first dimension is smaller than the second dimension, and both first and second dimensions of a given set are smaller than the outer diameter for a given vent pipe.

Accordingly, it is a primary object of the present invention to provide a universal flashing effectively to seal, with at least a double set of projections for a given vent pipe diameter, and separate sets of projections to accomodate successively larger vent pipe diameters, and varying roof pitch angles. The preferred embodiment is a one-piece item of a flexible PVC material which has tested particularly well for both sealing and environmental resistance.

For further understanding of the objects and advantages of the present invention, two preferred embodiments hereafter are described, wherein reference is made to the accompanying drawings.

DESCRIPTION OF THE PREFERRED EMBODIMENT

Figure 1:
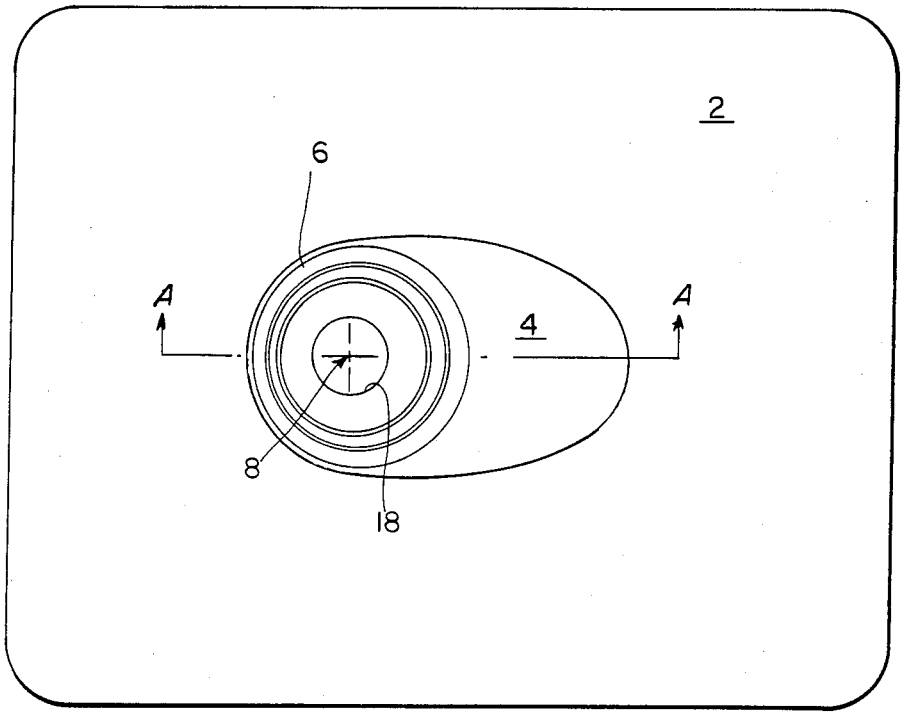
FIG. 1 is a top view of a preferred embodiment of the present invention.
Figure 2:
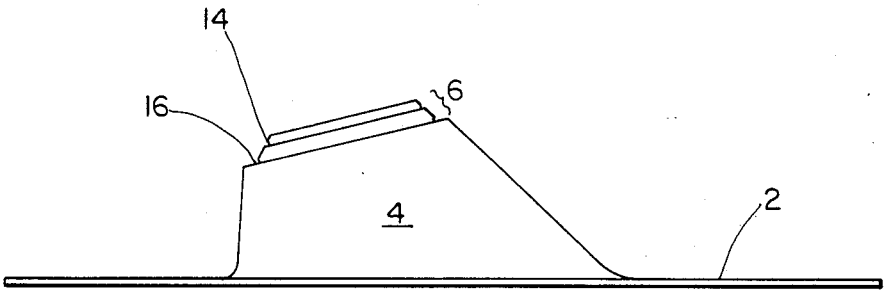
FIG. 2 is a side elevation view of the flashing of FIG. 1.

FIGS. 1 and 2 illustrate a preferred embodiment of the present invention, which is adapted to accommodate three varying vent pipe diameters, wherein sealing is accomplished by at least two inwardly extending projections. The flashing basically comprises a planar base flange, 2, a frustoconical body member, 4, and a ring collar assembly, 6. The base flange is approximately 12 by 15 inches and accommodates various roof openings, with the preferred embodiment in one-piece and of a flexible material. The preferred material is flexible PVC, as available from B. F. Goodrich, catalog designation 72A, or purchased from Textrube, Houston, Tex. Flashings are subject to a national and local plumbing code approval, and test standards have been set by the International Association of Plumbing and Mechanical Officials (IAPMO), 5032 Alhambra Avenue, Los Angeles, Calif. 90032. Southern Building Code, B.O.C.A. and Local. The present flashing has undergone a rigorous life testing by Ramteck Laboratories, Inc. 14104 Orange Avenue, Paramount, Ca. 90723, an independent testing laboratory for WF Products Crop. to meet IAPMO standards, which focuses upon watertightness of the joint around the pipe and the ability of the flashing material to withstand the elements, particularly ultra violet and ozone degradation, and temperature extremes. The Uniform Plumbing Code, S807 (1979 edition) promulgated by the IAPMO, requires a waterproofing of rooftop joints around pipes be sealed water-tight with lead, copper, galvanized iron or other approved flashings and flashing materials. Applicant's preferred embodiment has undergone an accelerated six year age test, comprisng 2,000 hours of exposure to a hostile environment, and has maintained a two-foot hydrostatic head of water above the base flange.

Figure 3:
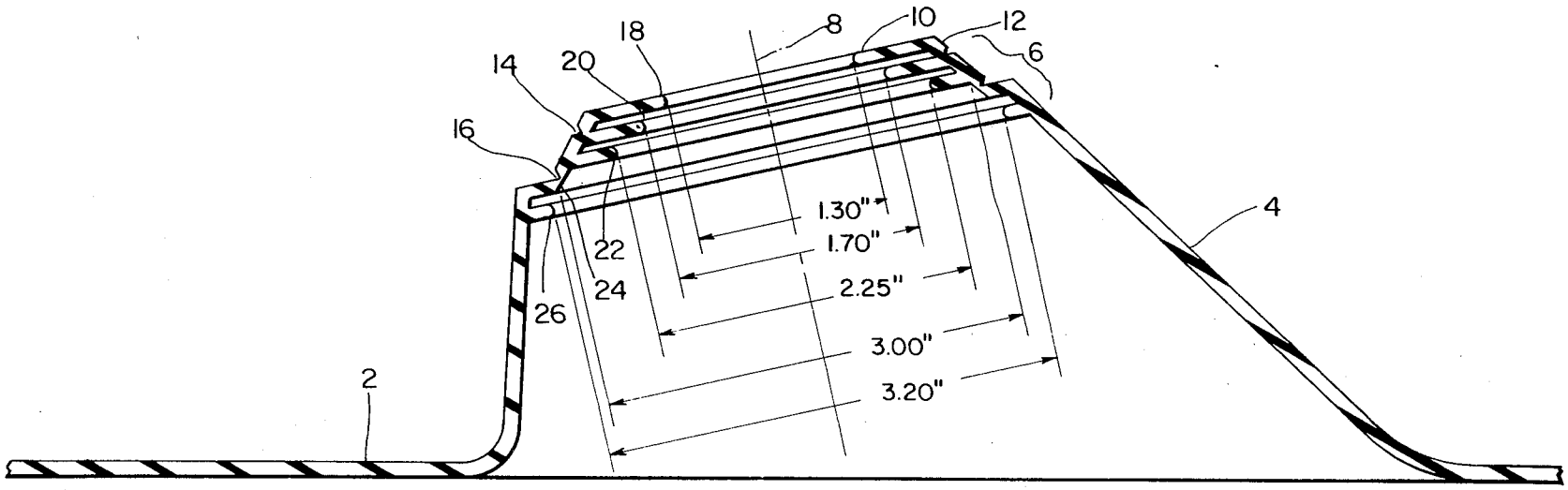
FIG. 3 is a cross-sectional elevation view taken through the flashing along line A—A of FIG. 1.
Figure 7:
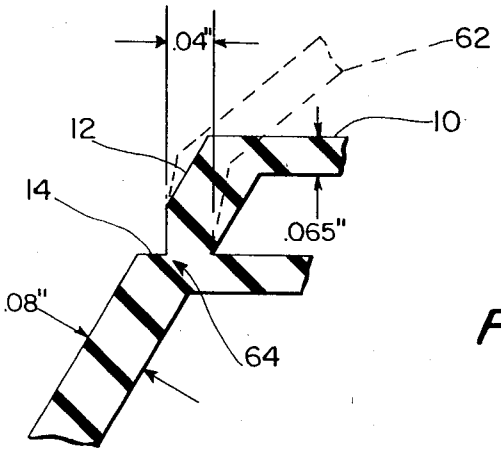
FIG. 7 is an enlarged fragmentary detailed cross-section view of a set of sealing projections.

FIGS. 1 and 3 show a centerline, 8, which is an axis of symmetry of the body member 14, that is inclined to the planar base flange, 2, at an angle consistent with flange mounted on a standard pitch roof angle. Centerline 8, is a preferred centerline for a vent pipe to be used with the present invention, though vent pipes oriented at an angle to flashing centerline, 8, also are accommodated. FIG. 3 shows in section three sets of projections, for three common vent pipe sizes. The first set comprises a first projection, 10, with a proximate end attached to a front portion of the frustoconical wall member and extending inwardly to a distal end, 18, which defines a circular dimension (1.30 inches) symmetrical about the body centerline, 8. The representative projection, 10 has a preferred wall thickness of 0.065 inches, and the associated body member 12, has a preferred wall thickness of 0.08 inches. Similarly, a second projection, 20, of the first set for accommodating a 1.5 inch I.D. vent pipe is parallel to the first projection, and extends from a second location on the body member to a distal end to define a second circular dimension (1.70 inches) about said centerline, 8. A second set of sealing projections comprises the projection, 20, as a first projection of the set, with the projection, 22, becoming a second projection, of the second set. This set is usable for a 2-inch pipe, with modification of the as-molded device simply being accomplished by inserting a knife slot approximately 1" to 1½" long at notch 14, and separating by inserting finger into knife slotted opening above 1 and ripping off top section at 14, at that frangible wall section. As shown more clearly in FIG. 7, notch section 14 has a lower surface colinear with the upper surface of the projection, 20, and removal of the material there above, as shown at 62, leaves a cantilevered projection and wall section which has flexure characteristics similar to those which existed for the juncture between the first projection, 10, and its associated wall member, 12. As shown in FIG. 3, the first dimension for the second set is 1.7 inches and the second dimension for the second set is 2.25 inches, which is well adapted to seal around a 2 inch I.D. vent pipe, which has an outer dimension on the order of 2.5 inches, approximately.

In the preferred embodiment FIG. 3, a third set is defined separately from the first two sets, and consists of a first projection, 24, and a second projection, 26, with the frangible wall section being located at a juncture of the top surface of the first projection, 24. This top section can be removed by inserting a knife slot approximately 1" to 1½" long and inserting finger into knife slotted opening and ripping off top section at notch 16. The first dimension for the third set is 3.0 inches with the second dimension, at the inner extension of projection, 26, being shown as 3.2 inches, consistent with a typical cast iron or plastic 3.0 inch I.D. pipe having an O.D. of approximately 3.5 inches. FIG. 3 further illustrates that the frustoconical body member, 4, is unitary with the sealing ring collar assembly, 6, and similarly is flexible to enable a minimized stress orientation of the seals about a given vent pipe orientation.

Figure 4:
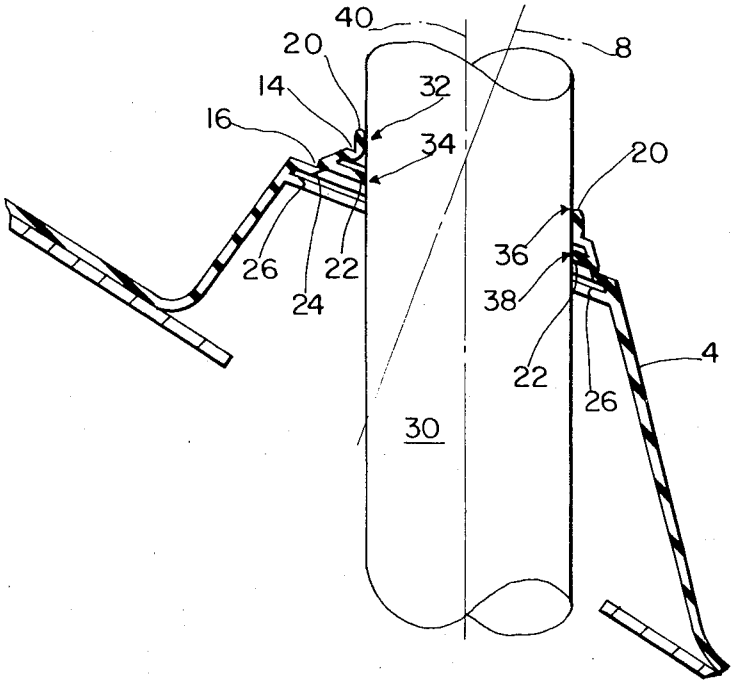
FIG. 4 is a partial section elevation view of a preferred embodiment installed around one vent pipe diameter.

FIG. 4 illustrates a 2 inch I.D. vent pipe inserted at an angle to the body member centerline, 8. The centerline of the vent pipe, 40, is shown for a roof slope angle greater than the most common roof slope angle, wherein the vent pipe centerline is colinear with the body centerline, 8. The 1.7 inch circular dimension shown in FIG. 3 will respond to the hoop stresses of distension and become ovalized into an elliptical contact with the vent pipe in the orientation shown in FIG. 4, with the first projection of the second set, 20, also having a sudden wall cross-section change in the vicinity of the notch, 14. Hence, flexure of the first projection, 20, will tend to occur along the projection. FIG. 4 also illustrates that ovalization effects will not prevent flexible first projection, 20, from assuming a high level of contact, 32, at the upper vent pipe side, and also at the bottom vent pipe side, 36. Note also that the second projection of this second set, 22, also contacts the upper side, 34, of pipe, 30, while maintaining contact at the lower side, at 38. Hence, a tight dual or labyrinth sealing occurs as a consequence of the cantilever between the 0.065 inch thick projection and an adjacent 0.08 inch thick wall section, which prompts localized flexing and a wiping seal against somewhat irregular vent pipe outer surfaces.

Figure 5:
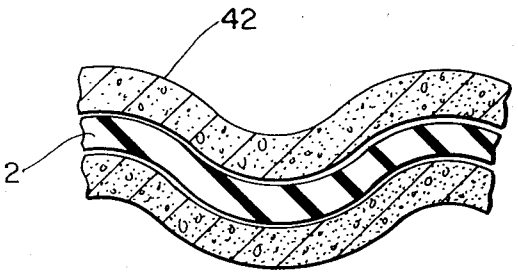
FIG. 5 is a cross-sectional view of a preferred base flange in combination with a ceramic tile roof.

FIG. 5 illustrates a further advantage of the preferred embodiment of FIG. 3. If the flange, 2, is of the same elastomeric material, preferrably flexible PVC, it will follow contours of various roofing materials, including the illustrated tile roof, 42. Unlike multi-pieced flashings, this unitary flashing has the ability to adapt to any surface irregularities. Since the entire flashing will flex, it will and adopt the lowest energy state possible given the stress applied.

Figure 6:
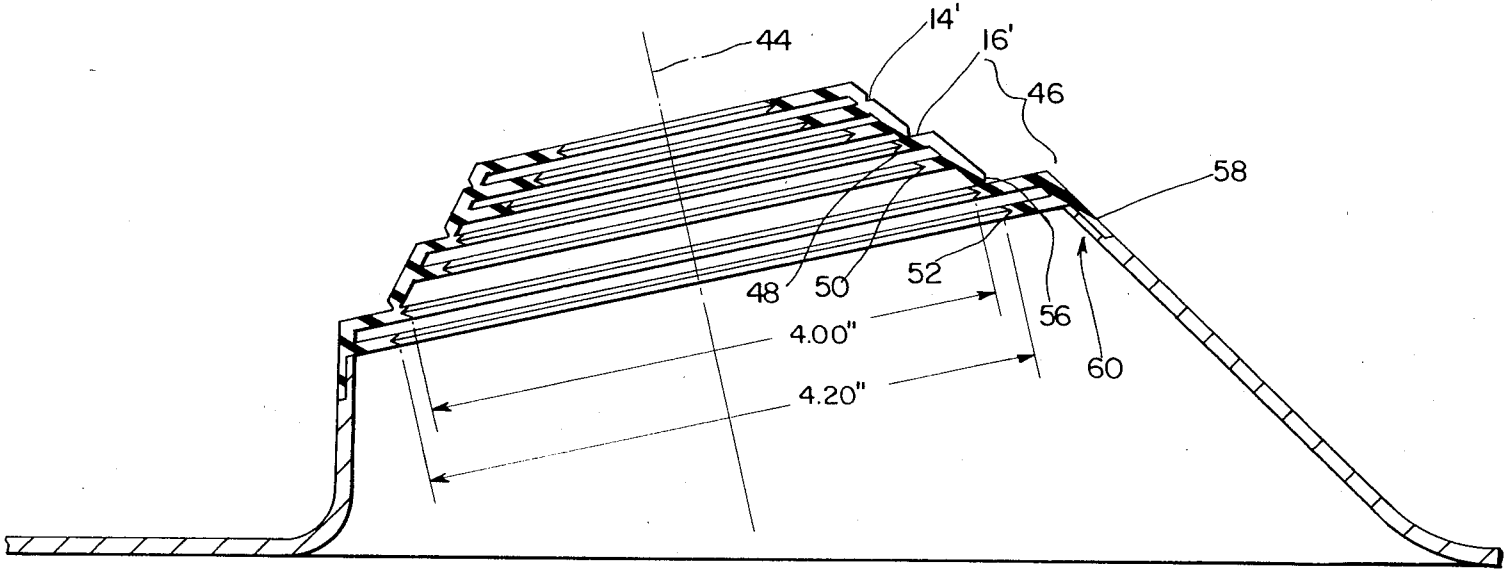
FIG. 6 is a cross-section elevation view of a second embodiment of the present invention.

A second embodiment of the invention is illustrated in FIG. 6, and comprises a four-way adaptibility (to four different vent pipe diameters), and also a relatively rigid base, should resistance to a hot tar, built-up roof environment be desirable. As shown by FIGS. 3 and 6, elements with equivalent function have like numerology. The centerline, 44, of FIG. 6 is an axis of symmetry for the entire frustoconical section, which now comprises an elastomeric upper portion and sealing ring collar assembly, 46, and a lowwer frustoconical portion and planar flange, 60. The two portions are bonded at a flange, 58, so that the elastomeric material is supported above a metallic lower body and flange which contacts the roof. Also shown in FIG. 6 is a modification to the shape of the inner dimension of each projection element, wherein a V-groove is provided at the inward end of each of these projections, which together comprise four sets of sealing members. For example, the third set comprises a first projection with inwardly directed V-groove, 48, and a second projection comprises an inwardly directed V-groove, 50. A fourth set, first projection is defined by removing frangibly material above the minimized wall thickness at notch, 56. The first projection for the forth set defines a diameter of 4.0 inches, and the second projection defines a diameter of 4.2 inches, consistent with a plastic 4.0 inch I.D. vent pipe, having a nominal outer diameter of 4.5 inches.

The concept of a separate metallic lower body and flange is useful if hot tar roof is contemplated, since hot tar melts at a temperature of approximately 550° F. Even if the metallic lower portion of FIG. 6 is used, the ring collar assembly again comprises a plurality of step sealing portions, with each portion adapted to engage a different vent pipe diameter and be separated frangibly from the wall of an elastomeric body member. Hence, a significant aspect of the present invention is an ability to seal various pipe diameters with separate sealing sets, each comprising first and second projections, and each projection cantilevered and disposed generally perpendicular to a centerline of the body. As in the preferred embodiment, illustrated in section at FIG. 3, the second embodiment of FIG. 6 allows each of the projections to be removable through a frangible wall section which is adjacent to the surface of a given projection, so that modification of the ring collar assembly for successively larger vent pipe diameters is accomplished simply and without altering the projection/wall thickness relationships. For both embodiments, a notch in the wall has a surface colinear with a top surface of an adjacent first projection for a new set, so that a constant wall thickness will be redefined whenever assemblies are removed. Hence, any first projection of a new set will have equivalent flexure characteristics, and thereby apply a similar sealing force against any vent pipe diameter. A further advantage of this stepped ring collar assembly approach is that if mild or hot weather is the expected environment, a 2 inch pipe, for example, can be inserted through the device without removing the first ring, (at notch 14), thereby having a set of three projections functioning as the seal. The flexible nature of each of the thin annular projections, 18, 20, 22, lends themselve to a wiping distension action, and in non-freezing environments, one can realize still further benefit by the additional labyrinth seal effect of 3 separate wiping flanges.

While certain embodiments illustrating the principles of my invention have been shown and described, and it is to be understood that the invention is to be defined solely by the scope of the appended claims.

I claim:

1. In a universal flashing for roof top and vent pipe geometries as characterized by differing pipe diameters and roof slope angles, wherein said flashing comprises a planar base flange adapted to engage a roof top surface and support the bottom of a frustoconical body member, having a centerline of symmetry, wherein the top end of said body member comprises a ring collar assembly adapted to be distended by, and sealingly engage against, outer diameters of more than one vent pipe diameter, the improvement in said flashing which comprises a ring collar assembly which comprises a plurality of stepped sealing portions, each portion adapted to engage a different vent pipe diameter and frangibly be separated as by inserting a knife point or a sharp object, cutting a slotted opening approximately 1" to 1½" long, inserting a finger into the slotted opening and ripping off a top section from the wall of said body member, wherein at least two sets of sealing projections are provided, and for a first given pipe diameter a sealing portion further comprises a first set of first and second projections separated by a connecting wall portion and disposed generally perpendicular to said body centerline, wherein said first set comprises at least two adjacent projections, wherein a first projection of said first set extends from a proximate end connected at a first location on said body member to a distal end which defines a circular flange surface spaced a first dimension about said centerline, and said second projection of said first set is below and longitudinally adjacent thereto, and extends from a proximate end connected at a second location on said body member to a distal end which defines a circular flange surface spaced a second dimension about said centerline, wherein said first dimension is less than said second dimension and both first and second dimensions are less than the outer diameter of said first given pipe diameter for which sealing engagement is desired, whereby the distal ends of the first and second projections in the first set resiliently and sealingly will engage separately against a first given vent pipe outer surface when used according to its intended purpose and the second projection in the first set also comprises a first projection in a second set, longitudinally below and adjacent to the first set, wherein, further, said projections are of a uniform thickness less than the wall thicknesses of the body member and each of said projections is removable from said body member through a frangible wall section defined as a reduced wall thickness within the connecting wall portion of said body member proximate to the surface of the below and immediately adjacent projection, so that the second projection for a given pipe diameter becomes the first projection for sealing a larger pipe diameter, and said frangible wall section is configured so that removal of a sealing section requires separation along a plane substantially colinear with the top surface of the adjacent projection, and at a point spaced outwardly from the distal end of said adjacent projection, so that the resulting separation contour has no effect upon the sealing ability of said adjacent projection, whereby modification of the ring collar assembly for successively larger vent pipe diameters is accomplished simply by separating one or more projections at one of said frangible wall sections.

2. An improved flashing according to claim 1, wherein the base flange, frustoconical body member and ring collar assembly are unitary and comprised of an elastomeric material adapted to conform both to an irregular roof top surface, and to flex slightly for varying roof top pitches, while maintaining a resilient sealing about a given vent pipe.

3. An improved flashing according to claim 1, wherein said base flange and at least a portion of the frustoconical body member adjacent thereto are comprised of a rigid material capable of withstanding temperatures in excess of approximately 550° F., and the remaining portion of said frustoconical body member comprises an elastomeric material.

4. An improved flashing according to claim 1, wherein each of said projections has a thickness which is less than the thickness of the wall of said frustoconical body member and said frangible wall section is defined by a notch having one surface which is colinear with the top surface of an adjacent projection, which is to become the first projection of a new set, whereby removal of sections above said frangible wall section redefines a constant wall thickness adjacent the new first projection, thereby ensuring a uniform sealing force for any given first projection of a set against a given vent pipe.

5. An improved flashing according to claim 1 wherein said flexible elastomeric material is flexible PVC.

* * * * *